US007506765B2

(12) United States Patent
Franzreb et al.

(10) Patent No.: US 7,506,765 B2
(45) Date of Patent: Mar. 24, 2009

(54) HIGH GRADIENT MAGNETIC SEPARATOR

(75) Inventors: Matthias Franzreb, Karlsruhe (DE); Christian Reichert, Weingarten (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 335 days.

(21) Appl. No.: 11/156,699

(22) Filed: Jun. 20, 2005

(65) Prior Publication Data

US 2006/0016732 A1 Jan. 26, 2006

(30) Foreign Application Priority Data

Jul. 16, 2004 (DE) ..... 10 2004 034 541

(51) Int. Cl.
*B03C 1/00* (2006.01)

(52) U.S. Cl. ..... 209/232; 210/695; 210/222; 96/1

(58) Field of Classification Search ..... 209/232, 209/231, 213, 217, 219, 221, 222, 223.1, 209/223.2, 224; 210/222, 695; 95/28; 96/1, 96/2

See application file for complete search history.

(56) References Cited

U.S. PATENT DOCUMENTS

| | | | | |
|---|---|---|---|---|
| 3,838,773 | A * | 10/1974 | Kolm | 209/10 |
| 5,019,272 | A * | 5/1991 | Kurahashi et al. | 210/695 |
| 5,669,599 | A * | 9/1997 | Toh et al. | 269/8 |
| 5,873,313 | A * | 2/1999 | Minami et al. | 110/220 |
| 6,093,318 | A * | 7/2000 | Saho et al. | 210/208 |
| 6,180,005 | B1 * | 1/2001 | Iannicelli | 210/222 |
| 6,224,777 | B1 * | 5/2001 | Iannicelli | 210/695 |
| 6,743,365 | B1 * | 6/2004 | Marlowe | 210/695 |
| 2007/0023326 | A1 * | 2/2007 | Armstrong et al. | 209/39 |

* cited by examiner

*Primary Examiner*—Patrick H Mackey
*Assistant Examiner*—Kalyanavenkateshware Kumar
(74) *Attorney, Agent, or Firm*—Klaus J. Bach

(57) ABSTRACT

In a high-gradient magnetic separator for the selective separation of magnetic particles from a suspension which is conducted through a matrix of plate-like separation structures of a magnetic material which are disposed in a magnetic field and through which the suspension is conducted, alternate plates of the separation structures are movable relative to the other plates which are stationary and are all mounted on a carrier by which they can be moved relative to the stationary plates at least during cleaning of the plates for the removal of magnetic particles collected on the plates.

9 Claims, 4 Drawing Sheets

HIGH GRADIENT MAGNETIC SEPARATOR

BACKGROUND OF THE INVENTION

The invention relates to a high-gradient magnetic separator for the selective separation of magnetic particles from a suspension.

The separation of ferro-, ferri- or para-magnetic particles from liquid or gaseous fluids by magnetic separators is a basic concept of chemical engineering used in numerous variants. A particular advantage of the principle of the magnetic separation resides in the possibility to selectively separate magnetic particles from a mixture with other, non-magnetic particles. The selection of the magnetic separator is based on the size and the magnetic properties of the particles.

Relatively large and highly magnetic particles such as magnetite ores with particle sizes >75 μm can be separated with simple drum or band separators. Finer, strongly magnetic particles up to a size of 10-20 μm can still be separated from an aqueous suspension by special drum separators. Yet finer particles in the micrometer range (about 0.1 to 20 μm) have been separated so far only by so-called high-gradient magnetic separation procedures.

The principle of high-gradient magnetic separation is based on the generation and the bundling of high magnetic field gradients by the introduction of a ferro-magnetic matrix in an outer magnetic field. The magnetic elements of the matrix consist generally of steel wool or respectively a wire mesh or profiled metal plates. They are magnetized by the outer field and develop magnetic poles which at certain locations strengthen or weaken the outer magnetic field. The high field strength gradients formed thereby provide for a strong magnetic force effective on para- or respectively, ferro-magnetic particles directed toward higher field strengths. The particles attach themselves to the induced magnetic poles of the matrix and are thereby removed from the suspension.

With the generation of very high field gradients and correspondingly high magnetic forces in connection with a fine-mesh matrix, the method of high gradient magnetic separation is very effective if the amount of magnetic contamination to be removed from a suspension is small. Typically the method is used in the processing of kaolinites or in the removal of corrosion products from condensate circuits.

After a certain period of operation however, the separators are charged with separated magnetic particles to such a degree that the storage capacity of the magnetic separator is exhausted and the magnetic particles collected on the matrix have to be removed. The matrix is generally cleaned after the magnetic field has been switched off by a strong water jet or by back-flushing with high fluid flow speeds. Based on the form and design of the matrix which may consist for example of steel wool or layered wire webs or nets and which consequently has numerous interstices in the matrix area locally dead volumes are present which are not or only insufficiently flushed by the cleaning fluid. In addition, the desire to keep the volume of the flushing fluid as small as possible, and to hold the required pumping power down the amount of the flushing fluid used and the flow speed of the fluid that can be obtained during flushing are limited. As a result, removal of the particles is only incomplete. Particularly particles with a high remnant magnetism are hard to remove. Consequently, these particles continue to strongly adhere to the matrix wires, which detrimentally affects the clean-up efficiency to a significant degree.

While there is a multitude of patents and publications concerning the particle separation, only few examinations exist concerning the filter back-flushing and matrix cleaning. However, an effective and complete matrix cleaning is important and even essential for many applications if only to satisfy technical economical and ecological conditions. Particularly if the magnetic separation of magnetic particles is an important partial step of a continuous overall process, an optimal filter operation requires minimization of the matrix cleaning duration and of the flushing volume required herefor.

With certain applications, for example, in connection with water purification, a complete cleaning of the matrix is not absolutely necessary, although it is desirable and economically advantageous in order to fully utilize the separation capacity. The matrix is cleaned by high speed flushing water in a counter-current flow. U.S. Pat. No. 5,019,272 discloses a high gradient magnetic separator with a filter housing including a matrix which is rotated while the matrix is subjected to the flux of a permanent magnet. The filter matrix is cleaned by a combination of a pulsed-flow cleaning liquid, centrifugal faces and an alternating magnetic field. The rotational movement however, in this case, is not provided as an energy input means for the cleaning but for the generation of an alternating magnetic field on the basis of permanent magnets.

Based on this state of the art, it is the object of the present invention to provide a high-gradient magnetic separator which comprises a mechanically simple, sturdy, flexible and relatively inexpensive arrangement for an efficient cleaning of the matrix.

SUMMARY OF THE INVENTION

In a high-gradient magnetic separator for the selective separation of magnetic particles from a suspension which is conducted through a matrix of plate-like separation structures of a magnetic material which are disposed in a magnetic field and through which the suspension is conducted, alternate plates of the separation structures are movable relative to the other plates which are stationary and are all mounted on a carrier by which they can be moved relative to the stationary plates at least during cleaning of the plates for the removal of magnetic particles collected on the plates.

The separator includes areas for the admission and the removal of the suspension wherein between an admission area and a removal area at least two separation areas are provided. Preferably, the matrix extends across a closed volume wherein the liquid is admitted to and removed from these areas via ducts. The separation areas are preferably formed by wire mesh or perforated metal foils or—sheets and may include reinforcement structures for accommodating the forces generated by the fluid flow or for the mounting and engaging of the sheets.

For the selective separation of magnetic particles from a suspension, the suspension is conducted via the admission area into the matrix and in the matrix through at least two separation areas. After passing the separation areas, the suspension is conducted out of the matrix via the discharge space while the magnetic particles are magnetically retained on the separation surfaces.

An important design feature of the invention, which is also advantageous in connection with the cleaning of the matrix, resides in the division of the separation area into at least two groups. The separation areas of each group are interconnected mechanically rigidly for example, by a housing, a support structure or a shaft and supported in the high gradient magnetic separator either rigidly or removably.

Preferably, the separation areas are divided into two groups wherein the group association of the separation areas which are disposed in the matrix preferably in a parallel arrangement alternates. Preferably, one group is firmly installed in the housing whereas the second group is supported on a carrier which is movably supported, the separation areas of the different groups being arranged in the matrix so as to alternate. The movably supported carrier is either motor operated or can be moved by hand. It is moved in cycles, that is, it is moved in a translatory way oscillating in one or more directions. In a preferred embodiment, the carrier comprises a shaft which is rotatably or laterally movably supported and around which the matrix and the separation areas extend in a rotationally symmetrical fashion. The frequency of the rotational or oscillating relative movement is—depending on the particular design—generally between 5 and 1000 Hz.

For the selective separation of magnetic particles from a suspension, the separation area groups mentioned above do not necessarily need to be movable relative to one another. However, a moderate relative movement of adjacent separation areas enhances the mixing of the suspension and provides for a more uniform treatment of the whole suspension volume during the separation and a more uniform deposition of magnetic particles on the available separation surfaces. However, from a certain thickness on the relative movements inhibit a stable deposition of the particles on the separation surfaces and therefore are counter-productive so that they should not be used during the separation.

For the cleaning of the matrix which is necessary in certain intervals, the provision of the relatively movable groups of separation areas mentioned above represent a significant improvement.

The matrix is cleaned preferably in a counter-current principle using a flushing fluid wherein the relative movement of at least two of the separation area structures generates in the flushing fluid turbulence, which, in combination with inertia—, that is centrifugal and gravity forces significantly enhances the release of the magnetic particles from the separation surfaces. Even with some magnetism remaining, this permits cleaning even under the influence of a magnetic field. In certain cases only the provision of such additional forces makes the release possible.

Below the invention will be described in greater detail on the basis of exemplary embodiments with reference to the accompanying drawings.

DESCRIPTION OF A PREFERRED EMBODIMENT

Figure 1:
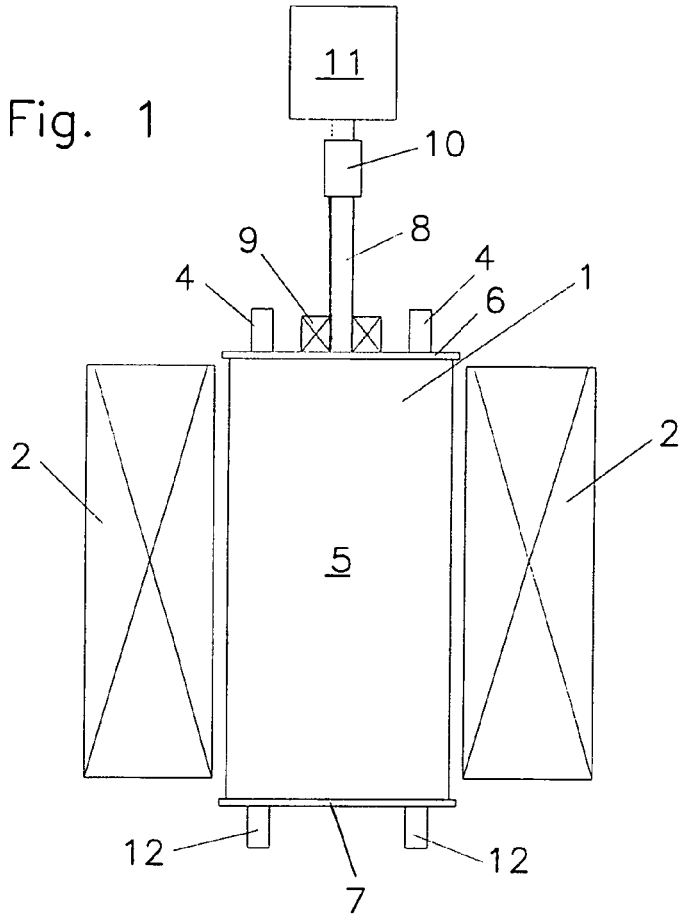
FIG. 1 shows an embodiment of a high-gradient magnetic separator according to the invention in principle, wall
Figure 2:
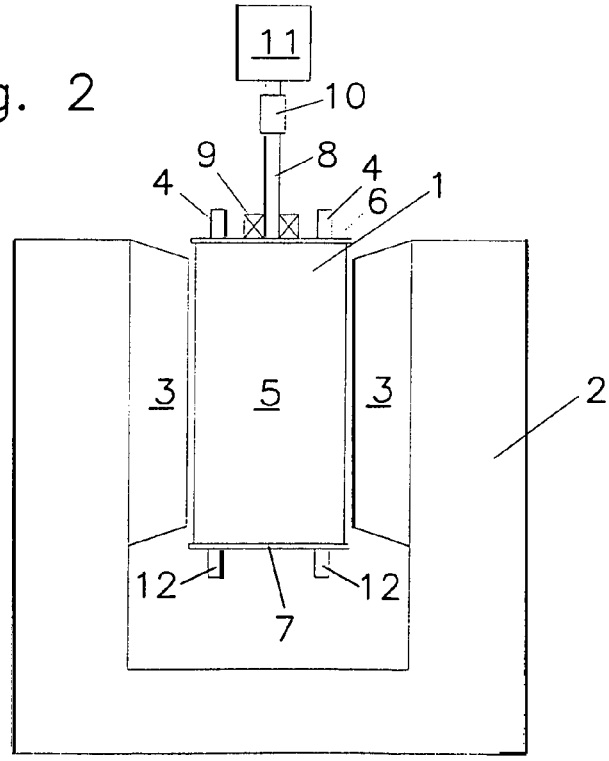
FIG. 2 shows another embodiment of a high-gradient magnetic separator.

As shown in FIGS. 1 and 2, the high-gradient magnetic separator 1 is disposed in the direct effective range of a magnetic system 2, which serves as a field source. As magnetic field source preferably electromagnets (FIG. 1), superconductive magnetic systems or permanent magnetic systems (FIG. 2) are used wherein the high gradient magnetic separator 1 is disposed in the magnetic coil opening or, respectively, between the pole shoes 3.

The actual high gradient magnetic separator comprises several partial units, that is, an essentially cylindrical housing 5 which is closed axially by a lid 6 and a bottom plate 7. A shaft 8 is rotatably supported concentrically in the housing 5, that is, in the shown embodiment by bearing 9 in the lid and or the bottom plate 7 in a sealed manner and is connected to a drive 11 by way of a clutch 10. The shaft, the housing, the lid and the bottom plate all consist of non-magnetic material.

The core unit of the high gradient magnetic separator is the matrix which extends across the interior volume enclosed by the housing 5, the lid 6 and the bottom plate 7 and in which the separation of the magnetic particles takes place. The suspension (fluid) including the magnetic particles to be separated enters the high gradient magnetic separator via the admission structure 4 and is distributed over the separator cross-section. The magnetic particles are separated from the fluid in the area of the matrix and are deposited on the separation discs 13 and 14. The cleaned fluid leaves the high-gradient magnetic separator via the discharge structure 12. The admission and discharge structures consist of several openings in the lid 6 and, respectively, the bottom plate 7 and are of conical shape for an improved flow distribution.

The matrix is constructed in accordance with a rotor stator principle and comprises (see FIG. 3 and 4) annular separation discs 13 and, respectively, 14, which are concentric with the shaft and connected alternatively to the housing 5 and to the shaft 8 for rotation therewith, and which divide the interior volume into rotationally symmetrical partial volumes disposed axially adjacent to one another.

Figure 5:
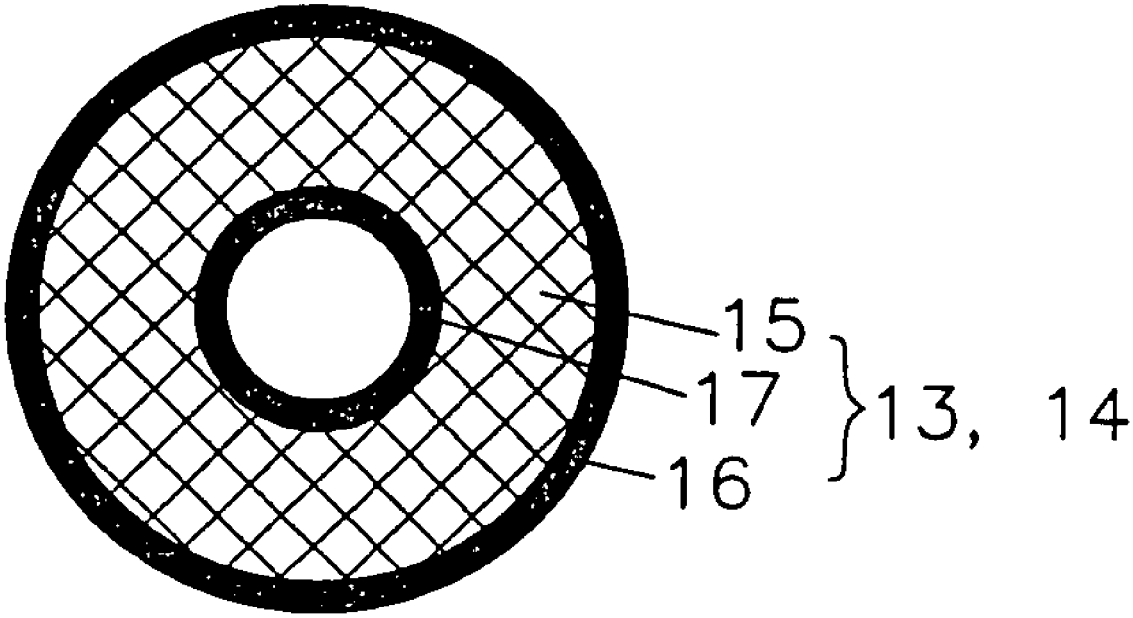
FIG. 5 shows the separation discs in a planar view.

The separation discs 13 and 14, shown in detail in FIG. 5, comprise each a separation area 15 through which the suspension flows and which consists of a magnetic material, preferably a wire mesh or a perforated metal foil or sheet. The separation area is delimited in each case by an outer and an inner stabilization ring 16 and, respectively, 17.

The rotating separation discs 14 are mounted onto the shaft 8 by way of inner stabilization rings 17 with inner non-magnetic spacer sleeves 18 disposed therebetween and clamped together axially by a clamping ring 19. In the same way, the stationary annular separation discs 13 are installed in the housing 5 alternately with non-magnetic outer distance sleeves 20 and clamped together by an end sleeve 21.

Figure 3:
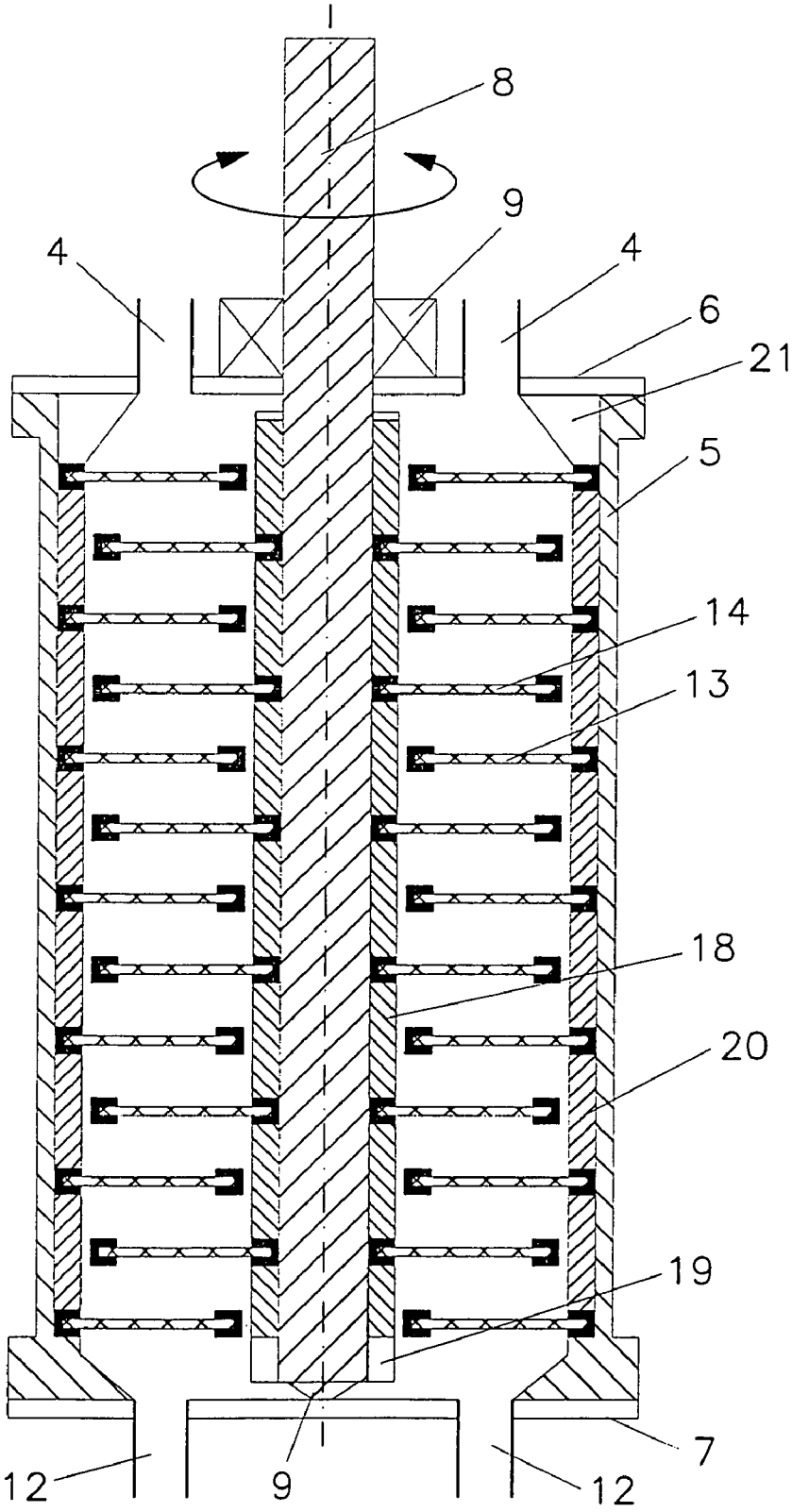
FIG. 3 is a cross-sectional view of a high-gradient magnetic separator with separation discs arranged fluidically in series.
Figure 4:
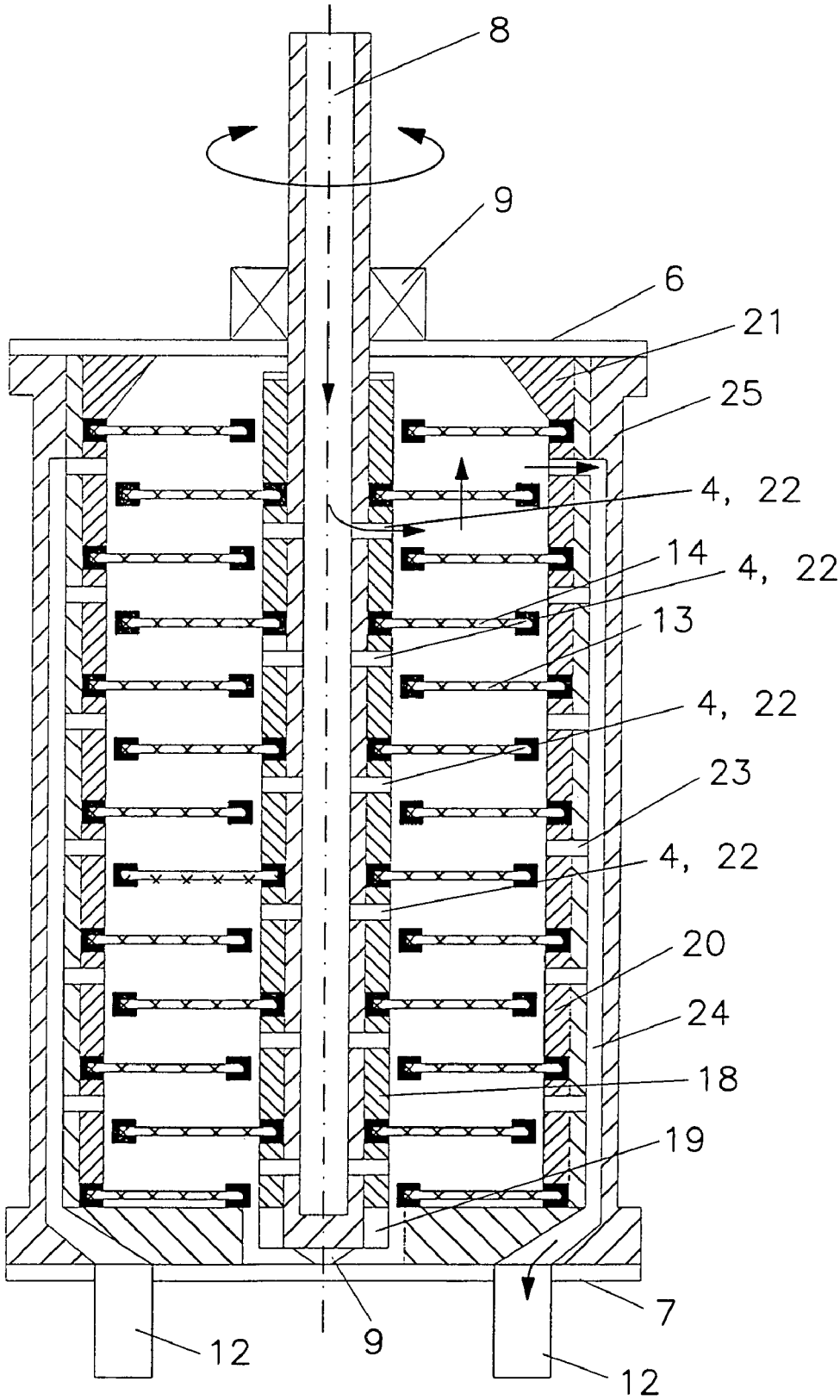
FIG. 4 is a cross-sectional view of a high gradient magnetic separator with separation discs arranged fluidically in parallel.

The inner and, respectively, outer stabilization rings 17, 16, which are not engaged, form with the respective inner and outer spacer sleeves 18, 20 an annular gap (see FIGS. 3 and 4).

FIG. 3 shows an embodiment with partial matrix volumes, which are arranged fluidically in series. In this case, the sleeves 21 in the admission area 4 and also the housing part at the discharge end 12 are conical so as to provide a fluidically optimized shape. This avoids the formation of dead volumes, particularly in the corner areas of the matrix and consequently possible mixing by retaining and time-delayed re-admixing of fluid fractions in the matrix.

FIG. 4 represents an alternative concept with partial volumes arranged in the matrix in parallel. In this embodiment, the suspension with the magnetic particles to be separated is admitted via the shaft 8, which is hollow, and several branch inlet openings 22 which extend radially from the shaft and form suspension outlet openings leading to every second part volume in the matrix. The cleaned fluid flows out of the part volumes which have no direct admission branch openings by way of outlet openings 23 which lead to a collecting channel 24 formed by the space between the walls of a double wall housing 25. Inlet and outlet openings 22 and, respectively, 23 are axially displaced so that the fluid flowing through the matrix must pass at least one separation disc.

The matrix is cleaned from time to time preferably in a counter-current procedure. As criterion for determining the cleaning intervals, the pressure loss in the separator is used which, correlated to the charge of the annular sedimentation discs indicate the need for matrix cleaning when a certain value is exceeded. For cleaning the matrix, a flushing fluid is conducted from the exit opening through the partial volumes to the admission area while, at the same time, the shaft 8 with the rotating annular separation discs 13 is rotated at high speed (about 100 to 500 U/min). With the turbulence formed in this way by shear forces in the fluid flow the magnetic particles deposited on the annular separation discs are dislodged and carried away. The separated particles are then carried by the flushing fluid out of the matrix.

The cleaning efficiency can further be improved by no longer subjecting the high gradient magnetic separator to a magnetic field. To this end, the magnetic field can be switched off or the high gradient magnetic separator can be moved out of the magnetic field.

Besides rotating the shaft 8, it may alternatively be subjected to an oscillation movement. An additional force can be established if the shaft is axially oscillated in addition to its rotation by a corresponding drive and bearing.

In addition to an efficient cleaning performance also the separation performance may be improved since by superimposing a slow rotational movement during the separation procedure the hydrodynamic conditions in the filter can be influenced so that the formation of certain flow paths is suppressed.

The design of the matrix as proposed on the basis of the exemplary embodiments described herein facilitate a modular and flexible set up of the high gradient magnetic separator. Alone by a simple exchange of the spacer sleeves 18 and 20, the number of the partial volumes and their size and also the number of annular separation discs can be changed in a simple manner and—like with a construction kit—they can be changed for partial areas of the matrix. For minimizing, the pressure loss it would for example be possible to provide for larger distances between the matrix elements in the upper part of the high gradient magnetic separator than in the lower part of the magnetic separator where the matrix elements would then be packed more closely together.

What is claimed is:

1. A high gradient magnetic separator (1) for the selective separation of magnetic particles from suspension, comprising a housing (5), a matrix forming a separation zone disposed in said housing (5), the housing (5) having an inlet area (4) for supplying the suspension to said matrix and an outlet area (12) for discharging the suspension from said matrix, said matrix consisting of alternately arranged spaced stationary and rotatable plate separation structures (13, 14) of magnetic material with spaces formed there between through which, the suspension including the magnetic particles is conducted, said stationary plate separation structures (13) supported by said housing (5) forming a stator and said alternate rotatable plate separation structures (14) being mounted on central rotatable carrier shaft (8) forming a rotor with passages arranged between the stationary plate separation structures (13) which are mounted to the housing and the rotatable plate separation structures (14) which are mounted to the rotatable shaft (8) being disposed in the flow path between the inlet area (4) and the outlet area (12) so that the suspension must pass through at least one of said passages, said matrix being disposed within a magnetic system (2) capable of magnetizing the plate separation structures (13, 14) of magnetic material.

2. A high gradient magnetic separator according to claim 1, comprising a motor drive for the rotor.

3. A high gradient magnetic separator according to claim 1, wherein the separation structures consist of one of a wire mesh, a perforated metal foil and a perforated metal sheet.

4. A high gradient magnetic separator according to claim 1, wherein the carrier is a shaft which is rotatably supported and the rotatable separation structures are disposed around the shaft in a rotationally symmetrical array.

5. A high gradient magnetic separator according to claim 4, wherein the rotor is also laterally movable.

6. A high gradient magnetic separator according to claim 4, wherein the separation structures are in the form of annular discs (13, 14).

7. A high gradient magnetic separator according to claim 4, wherein the housing (5) is cylindrical and extends between a bottom wall (7) and a lid (6), and a sealed bearing (9) is disposed in each of the bottom wall (7) and the lid (6) for rotatably supporting the shaft (8).

8. A high gradient magnetic separator according to claim 7, wherein the inlet and outlet areas (4, 12) are disposed in the lid (6) and the bottom wall (7), respectively.

9. A high gradient magnetic separator according to claim 7, wherein the housing (5) comprises two spaced inner and outer walls forming therebetween a collection channel (24), and radial bores (23) extend through the inner housing wall and form outlet openings (23) for conducting suspension out of the matrix and the shaft (8) is hollow and includes at least one radial bore (22) for supplying the suspension to the matrix.

* * * * *